US009446589B2

(12) United States Patent
Watanabe et al.

(10) Patent No.: US 9,446,589 B2
(45) Date of Patent: Sep. 20, 2016

(54) LIQUID EJECTING HEAD AND LIQUID EJECTING APPARATUS

(71) Applicant: SEIKO EPSON CORPORATION, Tokyo (JP)

(72) Inventors: Shunsuke Watanabe, Matsumoto (JP); Katsumi Enomoto, Samukawa-machi (JP)

(73) Assignee: Seiko Epson Corporation, Tokyo (JP)

( * ) Notice: Subject to any disclaimer, the term of this patent is extended or adjusted under 35 U.S.C. 154(b) by 39 days.

(21) Appl. No.: 14/204,446

(22) Filed: Mar. 11, 2014

(65) Prior Publication Data

US 2014/0285582 A1 Sep. 25, 2014

(30) Foreign Application Priority Data

Mar. 22, 2013 (JP) ..... 2013-059606

(51) Int. Cl.
*B41J 2/015* (2006.01)
*B41J 2/14* (2006.01)
*B41J 2/055* (2006.01)

(52) U.S. Cl.
CPC ..... *B41J 2/1433* (2013.01); *B41J 2/055* (2013.01); *B41J 2002/14241* (2013.01); *B41J 2002/14443* (2013.01)

(58) Field of Classification Search
None
See application file for complete search history.

(56) References Cited

U.S. PATENT DOCUMENTS

| | | | | |
|---|---|---|---|---|
| 2003/0234830 | A1 | 12/2003 | Sakamoto | |
| 2006/0082619 | A1* | 4/2006 | Yasui | 347/71 |
| 2007/0058005 | A1* | 3/2007 | Kanaya | 347/71 |
| 2011/0050804 | A1 | 3/2011 | Otokita | |
| 2011/0169897 | A1 | 7/2011 | Yokoyama et al. | |
| 2011/0242214 | A1* | 10/2011 | Kura | 347/44 |
| 2011/0316948 | A1 | 12/2011 | Asami et al. | |

FOREIGN PATENT DOCUMENTS

| | | |
|---|---|---|
| EP | 2594401 | 5/2013 |
| JP | 2004-082699 | 3/2004 |
| JP | 2010-228151 | 10/2010 |

OTHER PUBLICATIONS

European Search Report for Application No. 14160501.4 dated Jun. 16, 2014.

* cited by examiner

*Primary Examiner* — Erica Lin
(74) *Attorney, Agent, or Firm* — Workman Nydegger

(57) ABSTRACT

A liquid ejecting head includes a nozzle plate including a nozzle opening provided on a first surface of a flow path member with a flow path formed therein, and a protective member including a flexible portion that seals a portion of the flow path provided on the first surface of the flow path member. A position of a portion of the flow path member onto which the nozzle plate is attached and a position of a portion of the flow path member onto which the protective member is attached are different from one another in a discharge direction of a liquid.

10 Claims, 10 Drawing Sheets

LIQUID EJECTING HEAD AND LIQUID EJECTING APPARATUS

This application claims the benefit of Japanese Application No. 2013-059606 filed on Mar. 22, 2013. The foregoing application is incorporated by reference in its entirety.

BACKGROUND

1. Technical Field

Embodiments of the present invention relate to a liquid ejecting head, which ejects a liquid from a nozzle opening, and a liquid ejecting apparatus. In particular, embodiments of the invention relate to an ink jet recording head, which discharges a liquid such as ink, and an ink jet recording apparatus.

2. Related Art

The ink jet recording head, which is an example of the liquid ejecting head, discharges ink droplets from a nozzle opening onto an ejecting target medium. Ink adhering to the vicinity of the nozzle opening of a liquid ejecting surface and ink that has solidified in the vicinity of the nozzle opening can cause problems such as the discharge direction of the ink droplets being unstable and poor discharging such as the ink droplets not being discharged.

A liquid ejecting apparatus has been proposed that cleans ink, fluff, dust, paper dust or the like, which has adhered to the liquid ejecting surface, by wiping the liquid ejecting surface using a wiper blade such as a rubber plate (for example, refer to JP-A-2010-228151).

In addition, even if the liquid ejecting surface is wiped using the wiper blade, the ink, fluff, dust, paper dust or the like remains adhered to the surface of a protective member such as a cover head, which is provided on the liquid ejecting surface side. As a result, the ejecting target medium becomes dirty when the ejecting target medium or the like makes contact with the protective member. Therefore, an ink jet recording apparatus has been proposed in which a concave portion is provided between the protective member and the liquid ejecting surface, and the surface of the protective member and the liquid ejecting surface are cleaned using the wiper blade (for example, refer to JP-A-2004-82699).

However, when the level difference between the liquid ejecting surface of the nozzle plate and the surface of the protective member is too great, unwiped material remains when the wiper blade wipes the surface of the protective member and the liquid ejecting surface.

In addition, when the liquid ejecting surface of the nozzle plate and the surface of the protective member have the same height, that is, there is no level difference therebetween, the ejecting target medium is likely to make contact with the nozzle plate. There is a concern that problems such as jamming of the ejecting target medium, deformation of the nozzle plate, and exfoliation of the nozzle plate may be caused by the ejecting target medium contacting the nozzle plate.

Therefore, there is a great demand to appropriately adjust the level difference between the liquid ejecting surface of the nozzle plate and the surface of the protective member based on the properties of the ink jet recording head and the properties of the wiper blade.

Meanwhile, because the thickness of the nozzle plate and the thickness of the protective member are related to the discharge properties of the ink droplets, the strength, the shape and the like required from the nozzle plate and the protective member themselves, the thicknesses for an optimal level difference and the thicknesses required from the nozzle plate and the protective member themselves are in conflict. Also, there are restrictions to the manner in which the level difference can be adjusted.

Furthermore, this problem is present not only in an ink jet recording head, but also in a liquid ejecting head that ejects a liquid other than an ink.

SUMMARY

An advantage of some aspects of embodiments of the invention is to provide a liquid ejecting head and a liquid ejecting apparatus capable of adjusting the height between the liquid ejecting surface and the protective member in the liquid ejecting direction.

According to an aspect of the invention, a liquid ejecting head is provided. The liquid ejecting head includes a nozzle plate that includes a nozzle opening provided on a first surface of a flow path member with a flow path formed therein. The liquid ejecting head also includes a protective member that includes a flexible portion that seals a portion of the flow path provided on the first surface of the flow path member. A position of a portion of the flow path member onto which the nozzle plate is attached and a position of a portion of the flow path member onto which the protective member is attached are different from one another in a discharge direction of a liquid.

In this aspect, it is possible to easily adjust the height between the surface of the discharge side of the nozzle plate and the surface of the discharge side of the protective member by adjusting the attachment position of the portion of the flow path member without changing the thickness of the nozzle plate or the thickness of the protective member.

In one example, the flow path member includes a flow path forming substrate, in which a pressure generating chamber is formed, and a communicating plate, which is provided on the nozzle plate side of the flow path forming substrate. Accordingly, because the nozzle opening of the nozzle plate and the pressure generating chamber can be separated by providing the communicating plate, the liquid within the pressure generating chamber is not easily influenced by an increase in viscosity caused by the evaporation of water content in the liquid, which occurs in the proximity of the nozzle opening. In addition, because it is sufficient for the nozzle plate to only cover the opening of the nozzle communicating path that communicates the pressure generating chamber with the nozzle opening, it is possible to reduce the area of the nozzle plate and to achieve a reduction in costs.

In addition, the position of the portion of the flow path member onto which the nozzle plate is attached and the position of the portion of the flow path member onto which the protective member is attached can be adjusted to be different from one another according to an adjustment of a thickness in a lamination direction between the communicating plate and the flow path forming substrate. Accordingly, it is possible to adjust the height at low cost by only adjusting the thickness of the communicating plate without increasing the number of components.

In addition, the flow path member may include the flow path forming substrate, the communicating plate, and a spacer that is provided on an opposite side of the communicating plate from the flow path forming substrate. The position of the portion of the flow path member onto which the nozzle plate is attached and the position of the portion of the flow path member onto which the protective member is attached may be adjusted to be different positions according to an adjustment of a thickness in a lamination direction between the spacer and the communicating plate.

In addition, the protective member may include a compliance substrate, which is provided on the flow path member side and includes a flexible portion, and a protection plate, which is provided on an opposite side of the compliance substrate from the flow path member. The protection play may cover the flexible portion.

Furthermore, according to another aspect of the invention, a liquid ejecting apparatus includes the liquid ejecting head as described above.

It is possible to realize a liquid ejecting apparatus capable of adjusting the height between the surface of the nozzle plate and the surface of the protective member.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, detailed description of the embodiments of the invention will be given.

Figure 1:
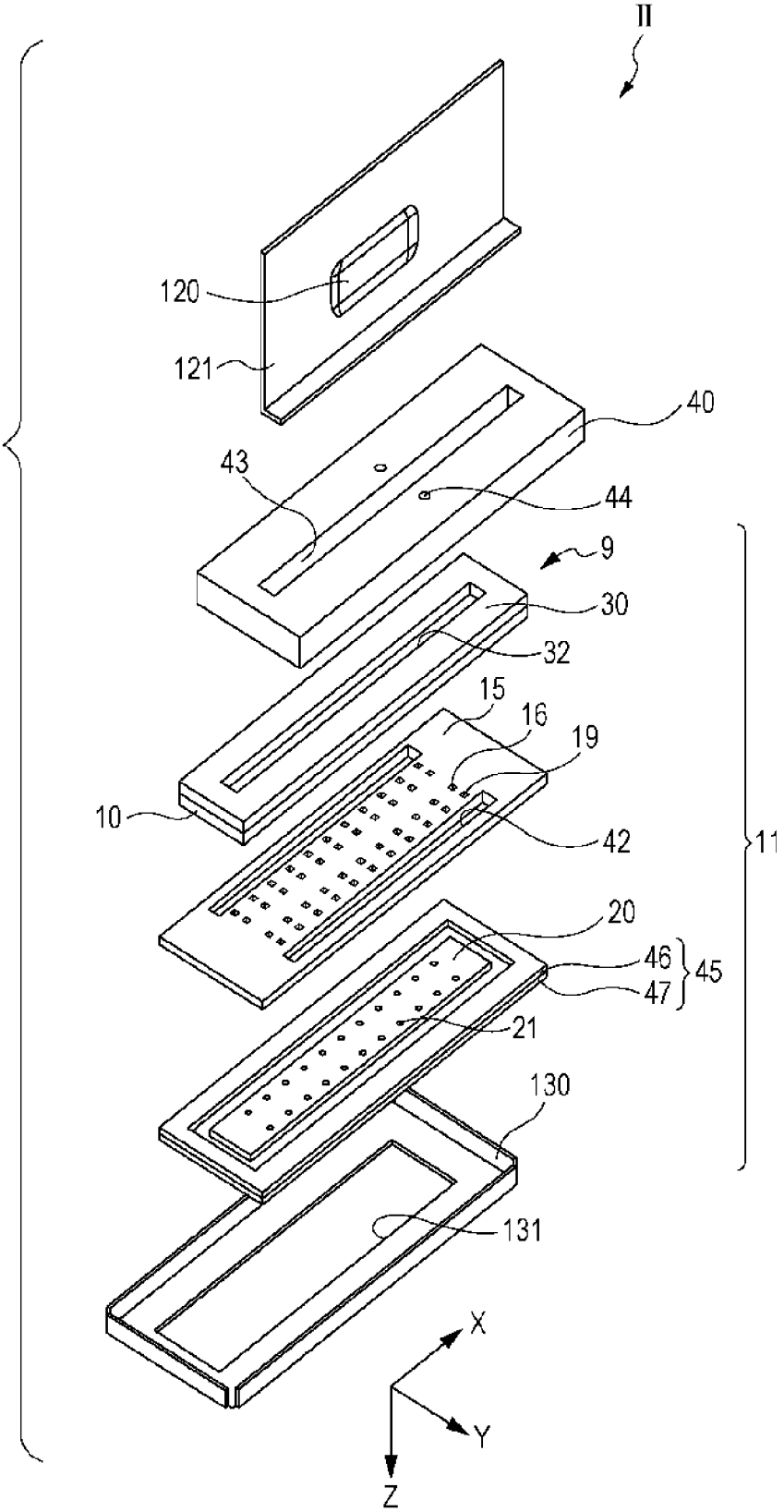
FIG. 1 is an exploded perspective view of an example of a recording head.
Figure 2:
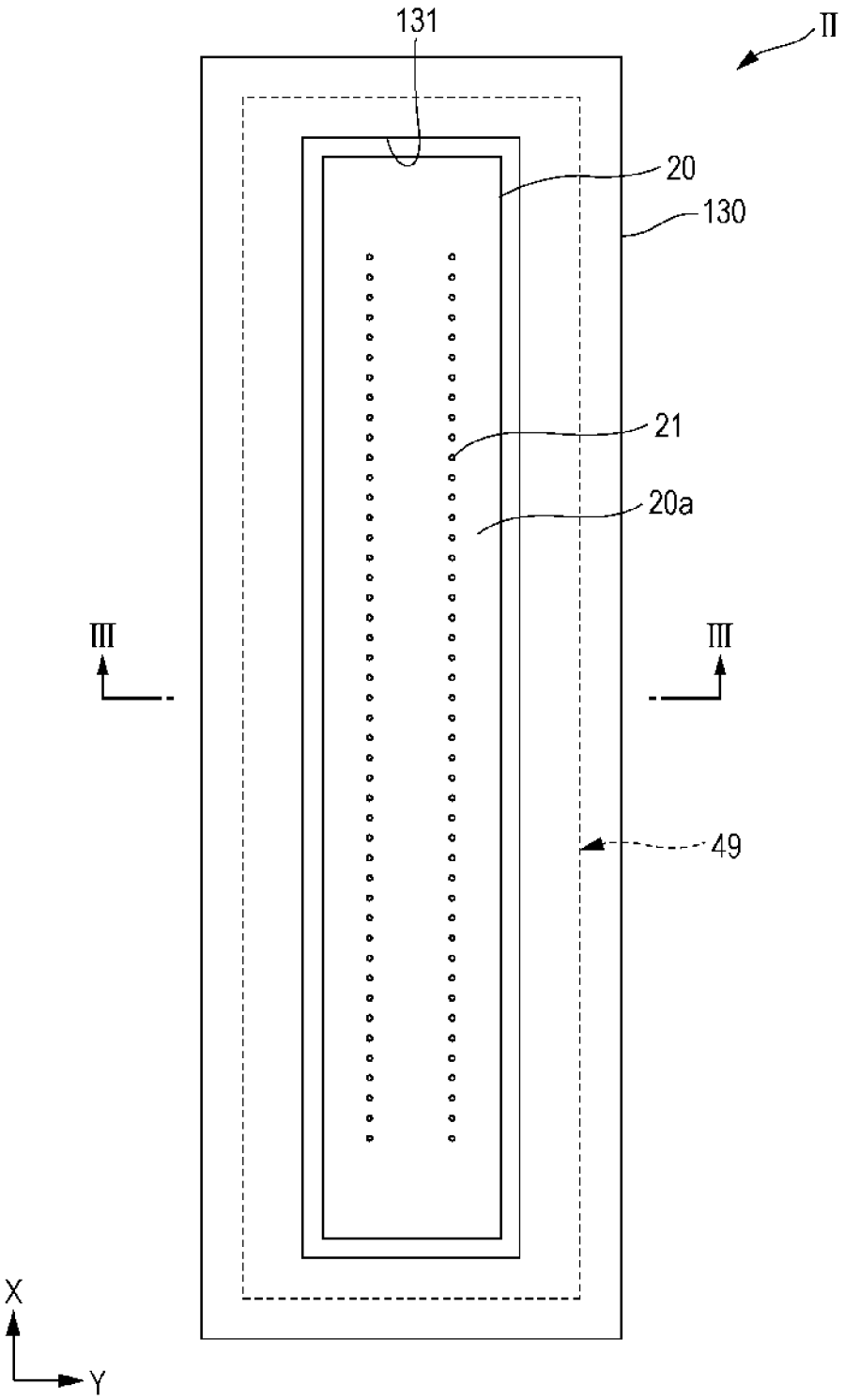
FIG. 2 is a plan view of the recording head according.
Figure 3:
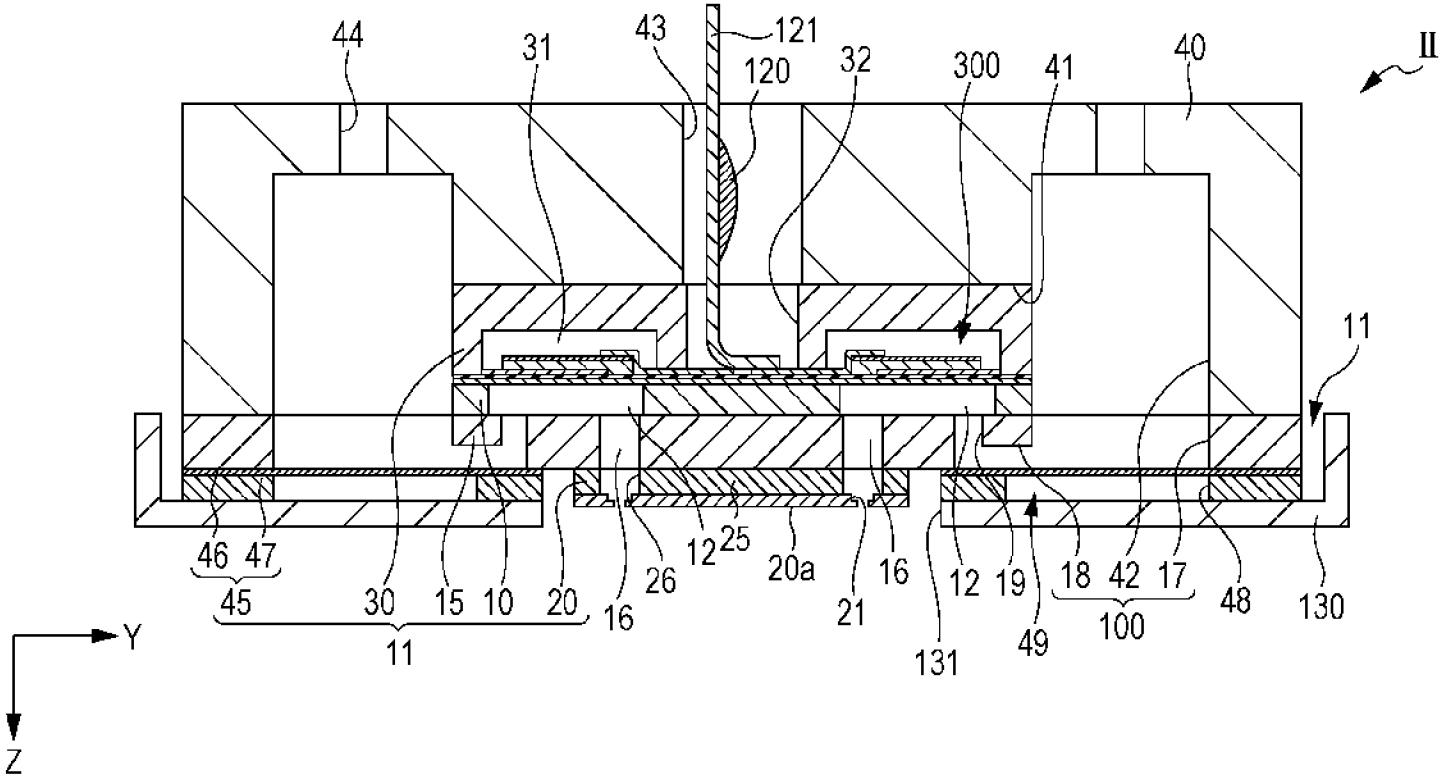
FIG. 3 is a cross-sectional view of the recording head.
Figure 4:
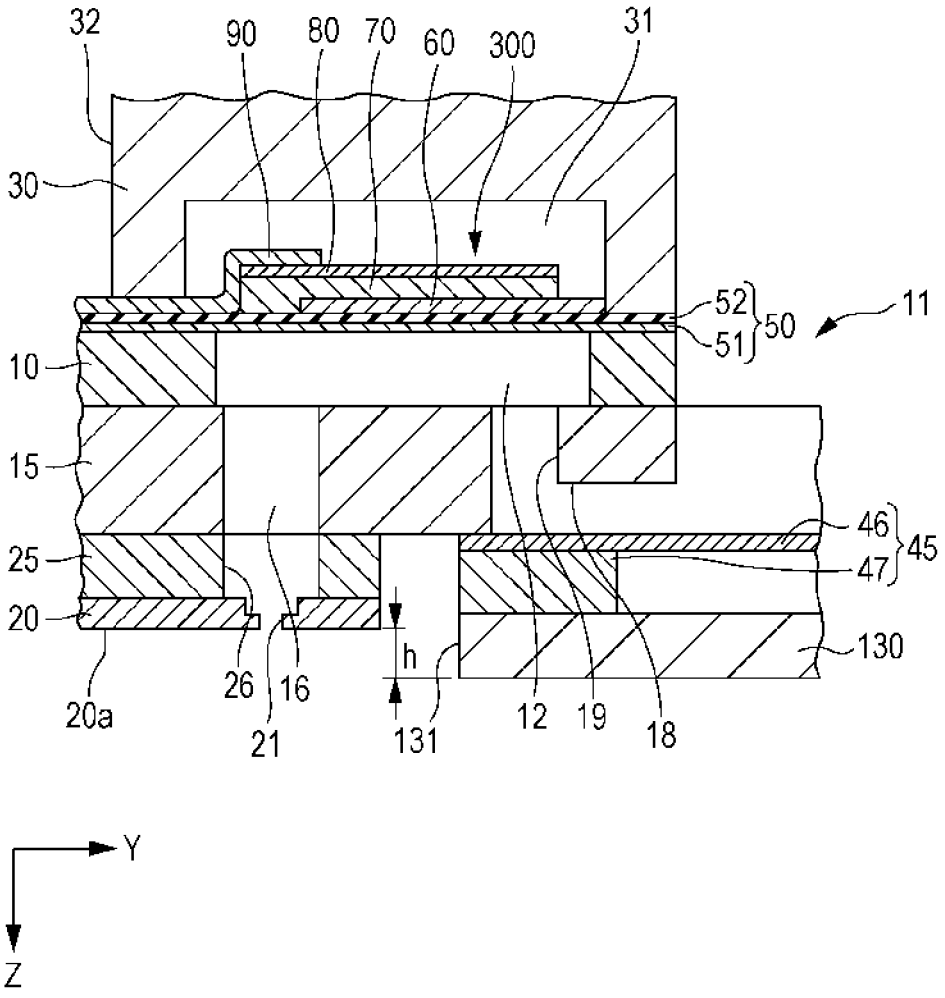
FIG. 4 is an enlarged cross-sectional view of the main components of the recording head.

FIG. 1 is an exploded perspective view of an ink jet recording head, which is an example of an embodiment of a liquid ejecting head, and FIG. 2 is a plan view of the ink jet recording head. In addition, FIG. 3 is a cross-sectional view across the line III-III of FIG. 2, and FIG. 4 is an enlarged cross-sectional view of the main components of FIG. 3.

As shown in FIGS. 1 to 4, an ink jet recording head II is provided with a plurality of members including a head main body 11, a case member 40 that is fixed to a first surface side of the head main body 11, and a cover head 130 that is fixed to a second surface side of the head main body 11. The head main body 11 includes a flow path forming substrate 10 that is an example of a flow path member, a communicating plate 15, a spacer 25, a nozzle plate 20 that is attached to the first surface side of the flow path member, a protective substrate 30 and a compliance substrate 45. Furthermore, the flow path member is configured by or includes the flow path forming substrate 10, the communicating plate 15 and the spacer 25. In addition, the protective member is configured by or includes the compliance substrate 45 and the cover head 130, which is an example of the protection plate.

The flow path forming substrate 10 that configures the head main body 11 may be formed from a metal such as stainless steel or Ni, a ceramic material, a representative example of which is $ZrO_2$ or $Al_2O_3$, a glass ceramic material, or an oxide such as MgO or $LaAlO_3$. The flow path forming substrate 10 may be formed from a silicon single crystal substrate. In the flow path forming substrate 10, pressure generating chambers 12, which are partitioned by a plurality of partition walls, are juxtaposed along a direction in which a plurality of nozzle openings 21 that discharge an ink are juxtaposed using anisotropic etching from the first surface side. Hereinafter, this direction will be referred to as a juxtaposition direction of the pressure generating chamber 12, or as a first direction X. In addition, in the flow path forming substrate 10, plural columns in which the pressure generating chambers 12 are juxtaposed in the first direction X are provided, and two columns are provided in one embodiment. The direction which the plurality of columns of the pressure generating chambers 12, which are formed along the first direction X, are provided to line up in will hereinafter be referred to as a second direction Y.

In addition, in the flow path forming substrate 10, on the first end side of the pressure generating chamber 12 in the second direction Y, a supply path may also be provided. The supply path has a narrower opening area than the pressure generating chamber 12 and applies a flow path resistance to the ink that flows into the pressure generating chamber 12.

In addition, the communicating plate 15, the spacer 25 and the nozzle plate 20 are sequentially laminated onto the first surface side of the flow path forming substrate 10. In other words, the communicating plate 15 is provided on the first surface of the flow path forming substrate 10, the spacer 25 is provided on an opposite surface side of the communicating plate 15 from the flow path forming substrate 10, and the nozzle plate 20 that includes a nozzle opening 21 is provided on the opposite surface side of the spacer 25 from the communicating plate 15.

A first nozzle communicating path 16 that communicates the pressure generating chamber 12 with the nozzle opening 21 is provided in the communicating plate 15. The communicating plate 15 has a larger area than the flow path forming substrate 10, and the nozzle plate 20 has a smaller area than the flow path forming substrate 10. Because the nozzle opening 21 of the nozzle plate 20 and the pressure generating chamber 12 are separated by the communicating plate 15 in this manner, the ink within the pressure generating chamber 12 is not easily influenced by an increase in viscosity caused by the evaporation of water content in the ink, which occurs in the proximity of the nozzle opening 21. In addition, because it is sufficient for the nozzle plate 20 to only cover the opening of the first nozzle communicating path 16 that communicates the pressure generating chamber 12 with the nozzle opening 21, it is possible to comparatively reduce the area of the nozzle plate 20. This achieves a reduction in costs. Furthermore, in one embodiment, a surface to which the nozzle opening 21 of the nozzle plate 20 is open and from which ink droplets are discharged is referred to as a liquid ejecting surface 20*a*.

In addition, the communicating plate 15 is provided with a first manifold portion 17 and a second manifold portion 18. A portion of the manifold 100 is configured by or includes the first and second manifold portions 17 and 18.

The first manifold portion 17 is provided to penetrate the communicating plate 15 in the thickness direction (the lamination direction between the communicating plate 15 and the flow path forming substrate 10).

In addition, the second manifold portion 18 does not penetrate the communicating plate 15 in the thickness direction, and is configured to be open to the nozzle plate 20 side of the communicating plate 15.

Furthermore, the communicating plate 15 includes a supply communicating path 19 that communicates with the first end portion of the pressure generating chamber 12 in the second direction Y independently for each of the pressure generating chambers 12. The supply communicating path 19 communicates the second manifold portion 18 and the pressure generating chamber 12.

The communicating plate 15 may be formed from a metal such as stainless steel or Ni, or a ceramic material such as zirconium. Furthermore, the communicating plate 15 may be formed from a material with a coefficient of linear expansion that is equal to a coefficient of linear expansion of the flow path forming substrate 10. In other words, when the communicating plate 15 is formed from a material with a coefficient of linear expansion largely different from that of the flow path forming substrate 10, warping occurs when the communicating plate 15 and the flow path forming substrate 10 are subjected to heating or cooling due to the difference in the coefficients of linear expansion. By using the same material for both the flow path forming substrate 10 and the communicating plate 15, that is, by forming the communicating plate 15 from a silicon single crystal substrate in one example, it is possible to suppress the occurrence of warping caused by heat, cracking and exfoliation caused by heat and the like.

The spacer 25 has approximately the same area (the area in relation to the first direction X and the second direction Y) as the nozzle plate 20. Therefore, the spacer 25 is only provided on the portion of the flow path member onto which the nozzle plate 20 is attached. In other words, the spacer 25 is not provided on the portion of the flow path member onto which the compliance substrate 45, which is an example of the protective member of the communicating plate 15, is attached. Therefore, a position of a portion of the flow path member onto which the nozzle plate 20 is attached (the position of the portion of the spacer 25 onto which the nozzle plate 20 is attached, and the position of the portion of the flow path member onto which the protective member (the compliance substrate 45) is attached, (the position of the portion onto which the communicating plate 15 is directly attached) are different positions in a third direction Z, which is discharge direction of the ink droplets (the lamination direction between the communicating plate 15 and the flow path forming substrate 10).

The spacer 25 is provided with a second nozzle communicating path 26 that communicates the first nozzle communicating path 16 with the nozzle opening 21. In other words, the pressure generating chamber 12 communicates with the nozzle opening 21 via the first nozzle communicating path 16 of the communicating plate 15 and the second nozzle communicating path 26 of the spacer 25.

Furthermore, the spacer 25 can be formed from a metal such as stainless steel or Ni, or a ceramic material such as zirconium or silicon, for example. In one embodiment, by using the same silicon single crystal substrate for both the communicating plate 15 and for the spacer 25, it is possible to suppress the occurrence of warping caused by heating or cooling, and cracking, exfoliation and the like caused by heat.

In addition, the spacer 25 may be selected such that a level difference h (see FIG. 4) between the liquid ejecting surface 20*a* and the surface of the cover head 130 (the surface of the liquid ejecting surface 20*a* side) is a desired value. The level difference h is obtained on the basis of the thickness (the total thickness in the third direction Z) in which the compliance substrate 45, which is an example of the protective member, and the cover head 130, which is an example of the protection plate, are laminated and the thickness of the nozzle plate 20.

The nozzle openings 21, communicate with the pressure generating chambers 12 via the first nozzle communicating paths 16 and the second nozzle communicating paths 26. The nozzle openings 21 are formed in the nozzle plate 20. In other words, the nozzle openings 21, which eject the same type of liquid (ink), are juxtaposed in the first direction X, and two columns of the nozzle openings 21 that are juxtaposed in the first direction X are formed in the second direction Y.

The nozzle plate 20 can be formed from a metal such as stainless steel (SUS), organic matter such as a polyimide resin, a silicon single crystal substrate or the like, for example. Furthermore, by using a silicon single crystal substrate as the nozzle plate 20, the coefficients of linear expansion of the nozzle plate 20 and the communicating plate 15 are the same and it is possible to suppress the occurrence of warping caused by heating or cooling, and cracking, exfoliation and the like caused by heat.

A vibration plate 50 is formed on the opposite surface side of the flow path forming substrate 10 from the communicating plate 15. In this embodiment, an elastic film 51, which may be provided on the flow path forming substrate 10 side and may be formed from silicon oxide, and an insulating film 52, which may be provided on the elastic film 51 and may be formed from zirconium oxide, are provided as an example of the vibration plate 50. Furthermore, the liquid flow path of the pressure generating chamber 12 and the like is formed by performing anisotropic etching on the flow path forming substrate 10 from the first surface side (the side of the surface to which the nozzle plate 20 is joined), and the second surface of the liquid flow path of the pressure generating chamber 12 and the like is formed by being partitioned by the elastic film 51.

In addition, the protective substrate 30, which is approximately the same size as the flow path forming substrate 10, is joined to the surface of a piezoelectric actuator 300 side of the flow path forming substrate 10. The protective substrate 30 includes a holding portion 31, which is an example of a space for protecting the piezoelectric actuator 300.

In addition, in this configuration, the case member 40 that forms a portion of the manifold 100, which communicates with the plurality of pressure generating chambers 12, and the head main body 11 by partitioning is fixed to the head main body 11. In one example, the case member 40 is substantially the same shape as the communicating plate 15 described above in a plan view, and is joined to the protective substrate 30 and the communicating plate 15 described above. Specifically, the case member 40 includes a concave portion 41 on the protective substrate 30 side. The concave portion 41 is of a depth in which the flow path forming substrate 10 and the protective substrate 30 are housed. The concave portion 41 has a wider opening area than the surface of the protective substrate 30 that is joined to the flow path forming substrate 10. Furthermore, the opening surface of the nozzle plate 20 side of the concave portion 41 is sealed by the communicating plate 15 in a state in which the flow path forming substrate 10 and the like are housed in the concave portion 41. Accordingly, in the peripheral portion of the flow path forming substrate 10, a third manifold portion 42 is formed by being partitioned by the case member 40 and the head main body 11. Furthermore, the manifold 100 of this embodiment is configured by or includes the first manifold portion 17 and the second manifold portion 18, which are provided on the communicating plate 15, and the third manifold portion 42, which is formed by being partitioned by the case member 40 and the head main body 11.

Furthermore, a resin, a metal and the like can be used as the material of the case member 40. Incidentally, by forming the case member 40 from a resin material, it is possible to perform mass production thereof at low cost.

In addition, the compliance substrate 45 is provided on the surface of the communicating plate 15 to which the first manifold portion 17 and the second manifold portion 18 are open. The compliance substrate 45 seals the opening of the liquid ejecting surface 20*a* side of the first manifold portion 17 and the second manifold portion 18.

In other words, the compliance substrate 45 that configures the protective member is directly fixed to the communicating plate 15. Therefore, the position of the portion of the spacer 25 to which the nozzle plate 20 is attached and the position of the portion of the nozzle plate 20 side of the communicating plate 15 to which the compliance substrate 45 is attached are different positions in at least the third direction Z.

The position of the portion of the flow path member to which the nozzle plate 20 is attached, and the position of the portion of the flow path member to which the protective member (the compliance substrate 45 that configures the protective member) is attached being the same position in the third direction Z is referred to as being attached to the communicating plate 15 on the same plane, for example. The plane of the communicating plate 15 naturally also includes inconsistencies in the height caused by processing errors that occur when processing the surface of the communicating plate 15 into a planar shape. In other words, instead of fixing the nozzle plate 20 and the protective member to the same surface of the communicating plate 15 that is processed into a planar shape, the spacer 25 is provided in a position of the communicating plate 15 to which the nozzle plate 20 is fixed. Thus, the nozzle plate 20 is attached to the surface of the spacer 25 and the positions in the third direction Z of the portions to which the nozzle plate 20 and the protective member are attached are thereby different positions.

In one embodiment, the compliance substrate 45 includes a sealing film 46 and a fixing substrate 47. The sealing film 46 is formed from a flexible thin film (for example, a thin film having a thickness of 20 μm or less and formed from polyphenylenesulfide (PPS), stainless steel (SUS) or the like). The fixing substrate 47 is formed from a hard material such as a metal such as stainless steel (SUS). Since the region of the fixing substrate 47 opposing the manifold 100 forms an opening portion 48 that is fully removed in the thickness direction, the first surface of the manifold 100 forms a compliance portion 49. The compliance portion 49 is an example of a flexible portion that is sealed only by the flexible sealing film 46.

Furthermore, the case member 40 may include an introduction path 44 that communicates with the manifolds 100 and supplies the ink to each of the manifolds 100. In addition, the case member 40 is provided with a connecting port 43 that communicates with a through hole 32 of the protective substrate 30 and a wiring substrate 121 is inserted through the through hole 32.

In the ink jet recording head II of such a configuration, when the ink is ejected, the ink is taken into the ink jet recording head II from an ink cartridge 2 (see FIG. 10) via the introduction path 44, and the inner portion of the flow path from the manifold 100 to the nozzle opening 21 is filled with the ink. Subsequently, the vibration plate 50 is deformed by being caused to warp together with the piezoelectric actuators 300 by applying a voltage to each of the piezoelectric actuators 300 corresponding to the pressure generating chambers 12 according to a signal from a drive circuit 120. Accordingly, the pressure within the pressure generating chamber 12 rises and ink droplets are ejected from the predetermined nozzle opening 21. Furthermore, in the ink jet recording head II, the liquid flow path may be from the connecting port 43 to the nozzle opening 21. In other words, the liquid flow path may be configured by or includes the connecting port 43, the manifold 100, the supply communicating path 19, the pressure generating chamber 12, the first nozzle communicating path 16, the second nozzle communicating path 26 and the nozzle opening 21.

In addition, the liquid ejecting surface 20*a* side of the head main body 11 is provided with the cover head 130, which is an example of the protection plate. The cover head 130 is joined to the opposite surface side of the compliance substrate 45 from the communicating plate 15 and seals the space of the opposite side of the compliance portion 49 from the flow path (the manifold 100). Furthermore, the cover head 130 is provided with an exposing opening portion 131 that exposes the nozzle opening 21. The exposing opening portion 131 may be of a size which exposes the nozzle plate 20. In one example, the size of the opening portion 131 is similar to that of the compliance substrate 45.

In addition, the cover head 130 is provided such that the end portion thereof is bent from the liquid ejecting surface 20*a* side so as to cover the side surface (the surface intersecting the liquid ejecting surface 20*a*) of the head main body 11.

In the ink jet recording head II, by providing the spacer 25 on the flow path member (such that the spacer 25 is between the nozzle plate 20 and the flow path member), it is possible to configure the position of the portion of the flow path member to which the nozzle plate 20 is attached and the position of the portion of the flow path member to which the protective member is attached to be different positions in the third direction Z. In other words, the spacer 25 causes the nozzle plate to be further away from the flow path member in the Z direction than the protective member. Therefore, it is possible to adjust the level difference h between the liquid ejecting surface 20*a* of the nozzle plate 20 and the surface of the protective member. In other words it is the liquid ejecting surface 20*a* side of the cover head 130 can be adjusted to a desired height.

The thickness of the nozzle plate 20 that is joined to the flow path member is different from the thickness of the compliance substrate 45 and the cover head 130 that are laminated together. Because the thickness of the nozzle plate 20 is less than the thickness of the protective member, when the level difference h is to be reduced, the thickness of the spacer 25 may be configured to be comparatively thicker. In addition, when the liquid ejecting surface 20*a* of the nozzle plate 20 is to protrude further in the discharge direction (the third direction Z) of the ink droplets than the surface of the liquid ejecting surface 20*a* side of the protective member, the thickness of the spacer 25 may be selected such that the thickness of the spacer 25 and the nozzle plate 20, which are laminated together, is thicker than the thickness of the protective member. In other words, it becomes possible to withdraw the liquid ejecting surface 20*a* of the nozzle plate 20 to be closer to the opposite side from the ejecting target medium than the surface of the cover head 130, for the liquid ejecting surface 20*a* to be level with the surface of the cover head 130, and to cause the liquid ejecting surface 20*a* to protrude further toward the ejecting target medium side than the surface of the cover head 130 without changing the thickness of the nozzle plate 20 or the protective member. In other words, the positional relationship between the liquid ejecting surface 20*a* and the protective member can be adjusted.

In contrast, when the thickness of the nozzle plate 20 is changed, since the shape of the flow path of the ink from the nozzle opening 21 to the pressure generating chamber 12 changes, the discharge properties of the ink droplets also change. In addition, when the thickness of the compliance substrate 45 and the cover head 130, which are laminated together, is changed, the size of the space of the compliance portion 49 changes. As a result, the compliance properties change. In addition, when the thickness of the cover head 130 is changed, there is a concern that the necessary strength for wiping with the wiper blade, or the flatness, which influences the strength, will be impaired. Since the thicknesses of the nozzle plate 20 and the protective member are related to the discharge properties, the strength, the shape and the like demanded thereof, when the level difference h is adjusted by changing the thicknesses of the nozzle plate 20 and the protective member, may conflict with the thicknesses for an optimal level difference h and the thicknesses demanded from the nozzle plate 20 and the protective member themselves. Furthermore, it is possible to improve the landing accuracy by narrowing the gap (the interval) between the ejecting target medium onto which the ink droplets land and the nozzle plate 20 by causing the nozzle plate 20 to protrude further in the third direction Z than the protective member. However, there is a concern that problems such as blockage of the ejecting target medium, so-called paper jamming, deformation, and exfoliation of the nozzle plate 20 caused by the ejecting target medium making contact with the side surface of the nozzle plate 20 will occur. In addition, when the nozzle plate 20 is positioned to be further recessed than the surface of the protective member and the level difference h therebetween is great, paper jamming and the deformation and exfoliation of the nozzle plate 20 are suppressed. However, when a wiper blade formed from rubber or the like wipes from the surface of the protective member to the liquid ejecting surface 20*a*, the position on the liquid ejecting surface 20*a*, on which the wiper lands on after separating from the protective member, is a position separated from the end portion of the opposite side of the nozzle plate 20 from the wiping direction. There is a concern that unwiped material will remain on the nozzle plate. In regard to such problems, the level difference h may be appropriately determined by considering the relative movement speed of the wiper blade, and the properties (such as elastic force and pressing force) of the wiper blade.

Furthermore, the spacer 25 is provided on the region to which the nozzle plate 20 is joined. However, embodiments of the invention are not particularly limited thereto. Here, description will be given of the modification example of the ink jet recording head II with reference to FIG. 5. Furthermore, FIG. 5 is a cross-sectional view showing the modification example of the ink jet recording head shown in FIGS. 1-4.

Figure 5:
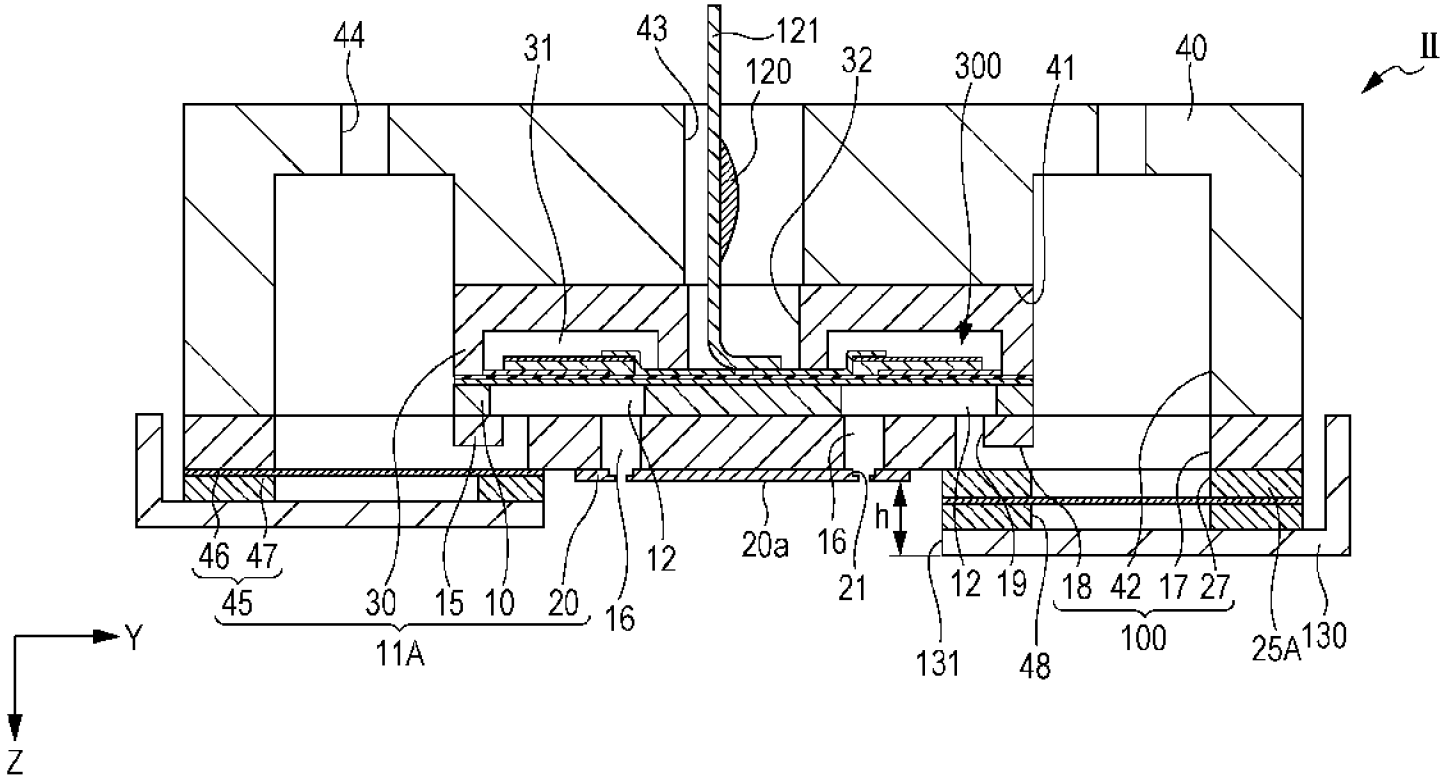
FIG. 5 is a cross-sectional view showing a modification example of the recording head.

As shown in FIG. 5, the ink jet recording head II includes a head main body 11A, the case member 40, the cover head 130, which is an example of the protective substrate, and the like.

In this embodiment, the head main body 11A includes the flow path forming substrate 10, which is an example of the flow path member, the communicating plate 15, a spacer 25A, the nozzle plate 20 and the compliance substrate 45. In other words, the flow path member is configured by or includes the flow path forming substrate 10, the communicating plate 15 and the spacer 25A. In addition, the protective member of this embodiment is configured by or includes the compliance substrate 45 and the cover head 130, which is an example of the protection substrate.

The spacer 25A has approximately the same area (the area of the first direction X and the second direction Y) as the compliance substrate 45 and is provided in the region of the communicating plate 15 to which the compliance substrate 45 is fixed. In other words, the compliance substrate 45 is fixed to the communicating plate 15 via the spacer 25A.

The spacer 25A is provided with a fourth manifold portion 27, which communicates with the first manifold portion 17 and penetrates in the thickness direction. Furthermore, the fourth manifold portion 27 of the spacer 25A is sealed by the compliance substrate 45. Accordingly, the manifold 100 may be configured by or includes the first manifold portion 17 and the second manifold portion 18, the third manifold portion 42, which is formed by being partitioned by the case member 40 and the head main body 11A, and the fourth manifold portion 27, which is formed in the spacer 25A.

The nozzle plate 20 is directly fixed to the communicating plate 15. Accordingly, in the third direction Z, the position of the portion of the flow path member to which the nozzle plate 20 is attached and the position of the portion to which the protective member (the compliance substrate 45) is attached are different positions. In other words, the Z position of the nozzle plate 20 is different from the Z position of the protective member relative to the communicating plate 15.

Even if such a configuration is adopted, it is possible to easily adjust the level difference h between the liquid ejecting surface 20*a* of the nozzle plate 20 and the surface of the liquid ejecting surface 20*a* side of the protective member in the third direction Z, to a desired height using the thickness of the spacer 25A. For example by changing the thickness of the spacer 25A the level difference h is adjusted.

Figure 6:
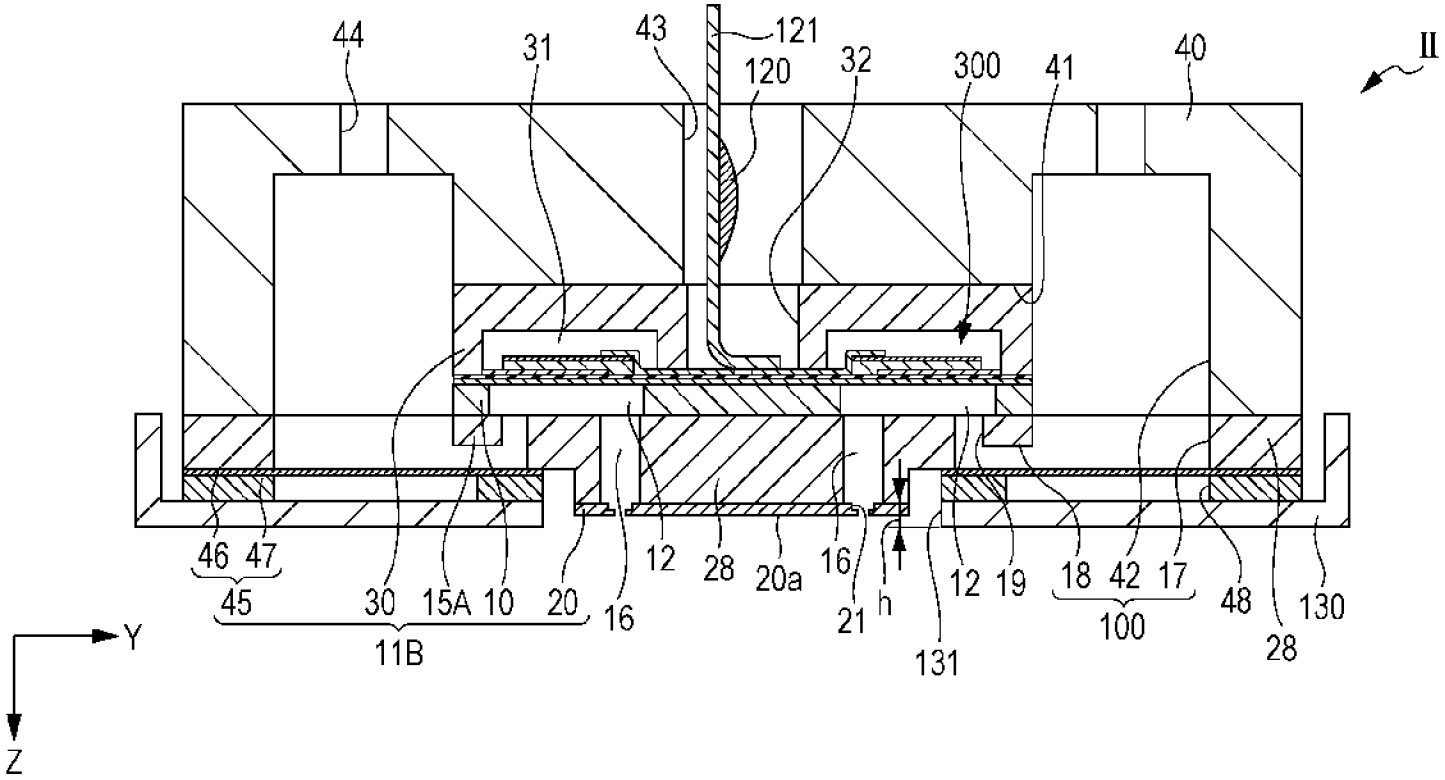
FIG. 6 is a cross-sectional view of an example of a recording head according.

FIG. 6 is a cross-sectional view of an ink jet recording head, which is an example of the liquid ejecting head. Note that members which are the same as those described above are assigned identical reference signs and numerals, and redundant descriptions will be omitted.

As shown in FIG. 6, the ink jet recording head II includes a head main body 11B, the case member 40, the cover head 130 and the like.

The head main body 11B includes the flow path forming substrate 10, which is an example of the flow path member, a communicating plate 15A, the nozzle plate 20 and the compliance substrate 45. In other words, the flow path member is configured by or includes the flow path forming substrate 10 and the communicating plate 15A. In addition, the protective member shown in FIG. 6 is configured by or includes the compliance substrate 45 and the cover head 130, which is an example of the protection substrate.

The communicating plate 15A includes a convex portion 28 in a position of a portion thereof to which the nozzle plate 20 is attached, and the convex portion 28 protrudes further in the third direction Z than a position of the portion of the communicating plate 15A to which the compliance substrate 45 is attached.

Accordingly, the position of the portion of the flow path member to which the nozzle plate 20 is attached and the position of the portion of the flow path member to which the protective member is attached are different positions in the third direction Z. In other words, a configuration is shown in which the communicating plate 15A is substantially formed by integrating the spacer 25 and the communicating plate 15 previously described.

Even in such a configuration, it is possible to adjust the level difference h between the liquid ejecting surface 20*a* and the surface of the cover head 130 to a desired height by adjusting the protrusion amount of the convex portion 28 in the same manner as in the embodiment described above. In other words, it is possible to withdraw the position in the third direction Z of the liquid ejecting surface 20*a* such that the position of the liquid ejecting surface 20*a* is further from the ejecting target medium than the surface (the surface of the liquid ejecting surface 20*a* side) of the cover head 130, for the liquid ejecting surface 20*a* to be level with the surface of the cover head 130, and to cause the liquid ejecting surface 20*a* to protrude further in the third direction Z than the surface of the cover head 130.

In addition, the convex portion 28 is provided in a region of the communicating plate 15A to which the nozzle plate 20 is attached. However, embodiments of the invention are not particularly limited thereto. For example, a convex portion that protrudes in the third direction Z may be provided on a portion of the communicating plate to which the protective member (the compliance substrate 45) is attached.

Figure 7:
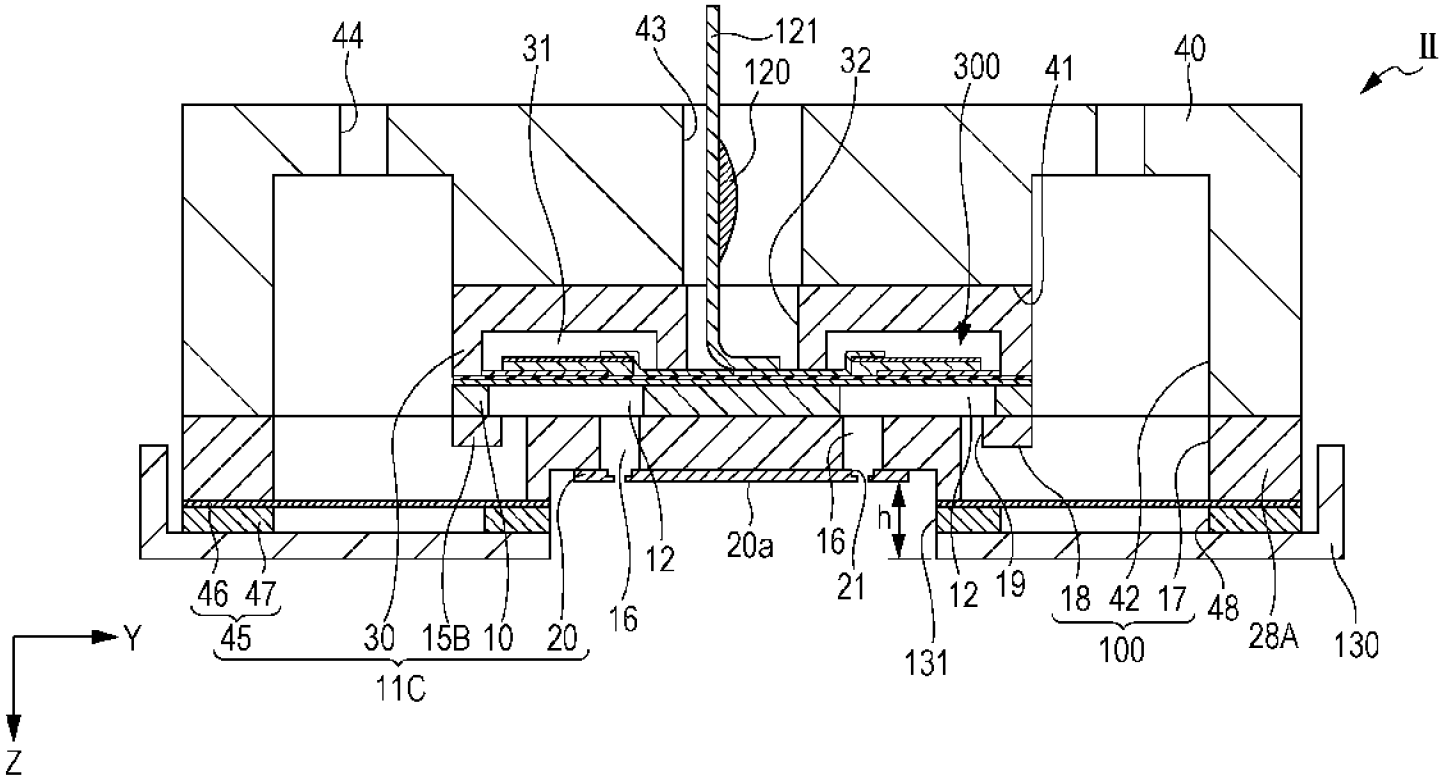
FIG. 7 is a cross-sectional view showing a modification example of the recording head.

Such an example is shown in FIG. 7. Furthermore, FIG. 7 is a cross-sectional view showing the modification example of the ink jet recording head shown in FIG. 6.

As shown in FIG. 7, the ink jet recording head II includes a head main body 11C, the case member 40, the cover head 130, which is an example of the protective substrate, and the like.

The head main body 11C includes the flow path forming substrate 10, which is an example of the flow path member, a communicating plate 15B, the nozzle plate 20 and the compliance substrate 45. In other words, the flow path member is configured by or includes the flow path forming substrate 10 and the communicating plate 15B. In addition, the protective member is configured by or includes the compliance substrate 45 and the cover head 130, which is an example of the protection substrate.

The communicating plate 15B is provided with a convex portion 28A in a position of a portion thereof to which the compliance substrate 45 is attached, and the convex portion 28A protrudes further in the third direction Z than a position of the portion of the communicating plate 15B to which the nozzle plate 20 is attached. The compliance substrate 45 is fixed to the protruding front end surface of the convex portion 28A. Accordingly, in the third direction Z, the position of the portion of the flow path member to which the nozzle plate 20 is attached and the position of the portion to which the protective member is attached are different positions.

In this manner, by providing either the convex portion 28 or the convex portion 28A on the communicating plate 15A or 15B, it is possible to adjust the position (the level difference h) in the third direction Z of the liquid ejecting surface 20*a* in relation to the surface of the cover head 130.

Figure 8:
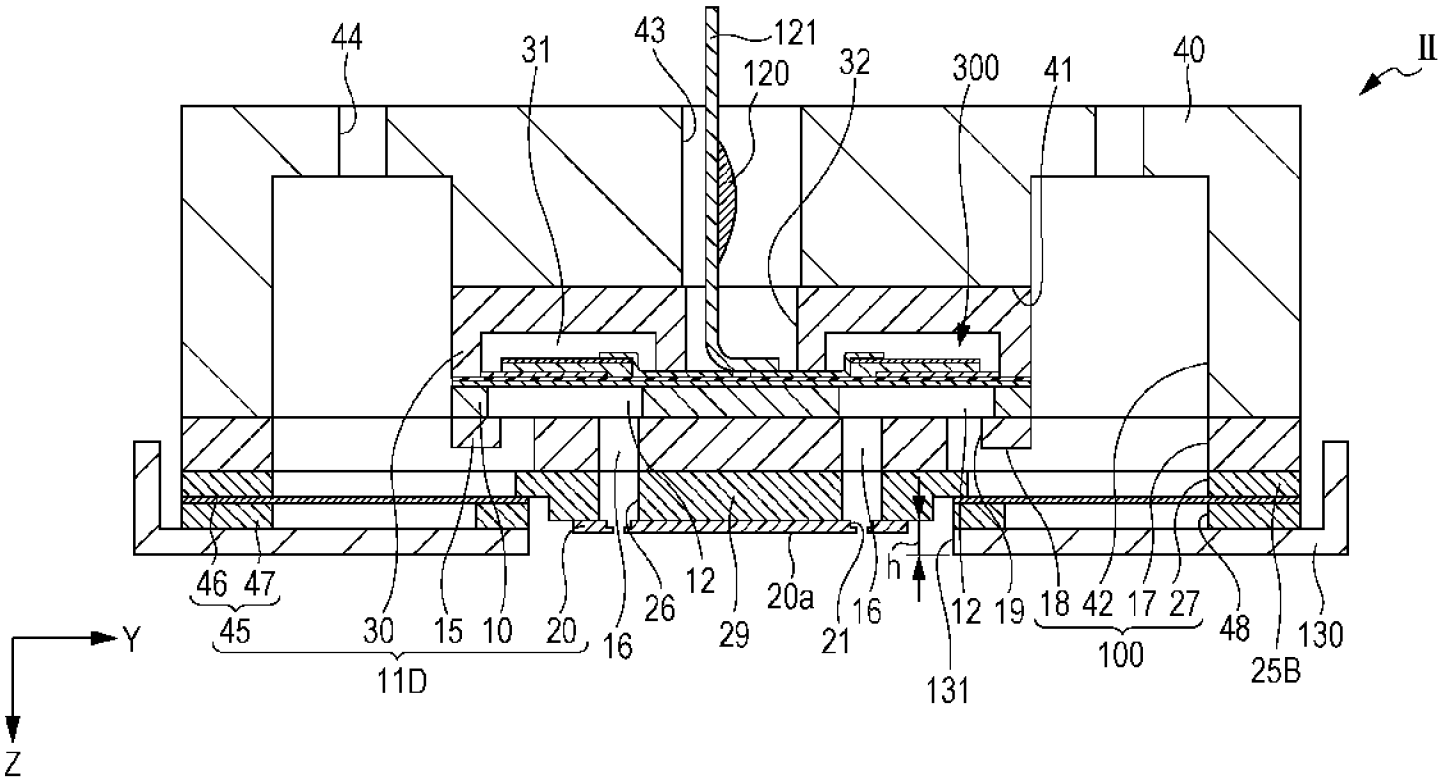
FIG. 8 is a cross-sectional view of an example of a recording head.

FIG. 8 is a cross-sectional view of the ink jet recording head, which is an example of the liquid ejecting head. Note that members which are the same as those in the embodiments described above are assigned identical reference signs and numerals, and redundant descriptions will be omitted.

As shown in FIG. 8, the ink jet recording head II of this embodiment includes a head main body 11D, the case member 40, the cover head 130 and the like.

The head main body 11D includes the flow path forming substrate 10, which is an example of the flow path member, the communicating plate 15, a spacer 25B, the nozzle plate 20 and the compliance substrate 45. In other words, the flow path member is configured by or includes the flow path forming substrate 10, the communicating plate 15 and the spacer 25B. In addition, the protective member is configured by or includes the compliance substrate 45 and the cover head 130, which is an example of the protection substrate.

The spacer 25B is fixed to the opposite surface side of the communicating plate 15 from the flow path forming substrate 10 and has approximately the same area (the area of the first direction X and the second direction Y) as the communicating plate 15.

In this manner, the nozzle plate 20 and the compliance substrate 45 that configures the protective member are directly fixed to the spacer 25B.

The thickness (the thickness in the third direction Z) of a region of the spacer 25B to which the nozzle plate 20 is attached is thicker than a region to which the compliance substrate 45 is attached. In other words, the region of the spacer 25B to which the nozzle plate 20 is attached includes a convex portion 29 that protrudes in the third direction Z. The nozzle plate 20 is attached to the protruding front end surface of the convex portion 29, and the compliance substrate 45 is attached to a region that is not protruding due to the convex portion 29.

In this manner, by configuring the spacer 25B to be of approximately the same area as the communicating plate 15 and setting the thickness of a region (the convex portion 29) of the spacer 25B to which the nozzle plate 20 is attached to be thicker than that of the region to which the compliance substrate 45 is attached, it is possible to adjust the position of the liquid ejecting surface 20*a* and the position of the surface of the protective member in the third direction Z. The position of the liquid ejecting surface 20*a* and the position of the surface of the cover head 130 are adjusted by adjusting the position of the portion to which the nozzle plate 20 is attached and the position of the portion to which the protective member is attached in the third direction Z. In other words, it is possible to withdraw the position of the liquid ejecting surface 20*a* in the third direction Z by the spacer 25B such that the position of the liquid ejecting surface 20*a* is further from the ejecting target medium than the surface (the surface of the liquid ejecting surface 20*a* side) of the cover head 130, for the liquid ejecting surface 20*a* to be level with the surface of the cover head 130, and to cause the liquid ejecting surface 20*a* to protrude further in the third direction Z than the surface of the cover head 130.

Furthermore, the second nozzle communicating path 26 of the first embodiment and the fourth manifold portion 27, which are described above, are provided on the spacer 25B.

Furthermore, the convex portion 29 is provided in a region of the spacer 25B to which the nozzle plate 20 is attached. However, embodiments of the invention are not particularly limited thereto. For example, a convex portion that protrudes in the third direction Z may be provided on a portion of the spacer to which the protective member (the compliance substrate 45) is attached.

Figure 9:
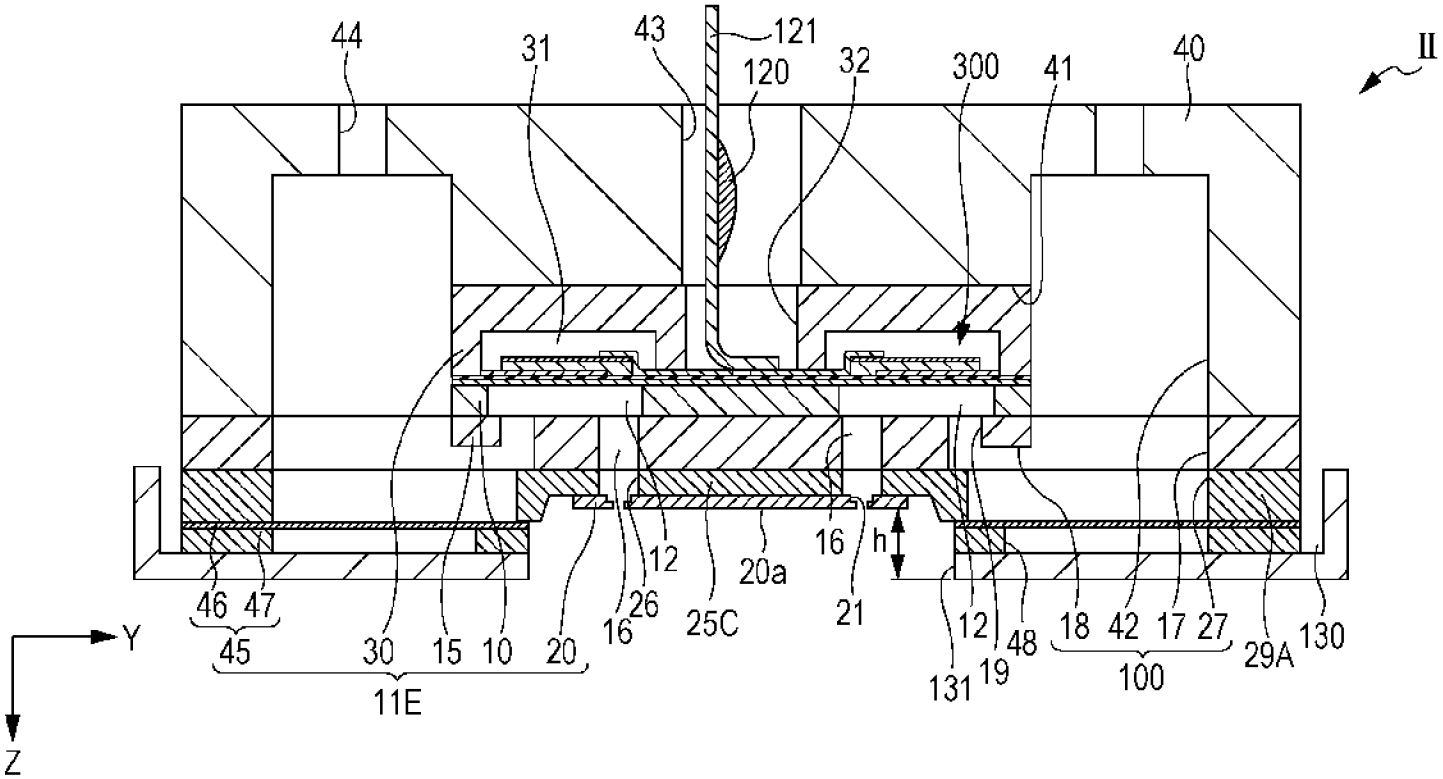
FIG. 9 is a cross-sectional view showing a modification example of the recording head.

Such an example is shown in FIG. 9. Furthermore, FIG. 9 is a cross-sectional view showing the modification example of the ink jet recording head shown in FIG. 8.

As shown in FIG. 9, the ink jet recording head II includes a head main body 11E, the case member 40, the cover head 130, which is an example of the protective substrate, and the like.

In this embodiment, the head main body 11E includes the flow path forming substrate 10, which is an example of the flow path member, the communicating plate 15, a spacer 25C, the nozzle plate 20 and the compliance substrate 45. In other words, the flow path member is configured by or includes the flow path forming substrate 10, the communicating plate 15 and the spacer 25C. In addition, the protective member is configured by or includes the compliance substrate 45 and the cover head 130, which is an example of the protection substrate.

The spacer 25C is provided with a convex portion 29A in a position of a portion thereof to which the compliance substrate 45 is attached. The convex portion 29A protrudes further in the third direction Z than a position of the portion of the spacer 25C to which the nozzle plate 20 is attached. The compliance substrate 45 is fixed to the protruding front end surface of the convex portion 29A. Accordingly, in the third direction Z, the position of the portion of the flow path member to which the nozzle plate 20 is attached and the position of the portion of the flow path member to which the protective member is attached are different positions.

In this manner, by attaching the nozzle plate 20 and the protective member respectively to the spacers 25B and 25C and providing either of the convex portion 29 and the convex portion 29A on the spacers 25B and 25C, it is possible to adjust the position (the level difference h) in the third direction Z of the liquid ejecting surface 20*a* in relation to the surface of the cover head 130.

Embodiments of the invention are described above. However, the basic configuration of embodiments of the invention is not limited to the above.

For example, in each of the embodiments described above, a configuration is exemplified in which the flow path member includes at least the flow path forming substrate 10 and one of the communicating plates 15 to 15B, and further includes one of the spacers 25 to 25C. However, the flow path member is not particularly limited thereto, and a configuration may also be adopted in which, for example, another member is included between the flow path forming substrate 10 and one of the communicating plates 15 to 15B, between one of the communicating plates 15 to 15B and one of the spacers 25 to 25C, or the like. Naturally, a configuration may also be adopted in which another member is included on the opposite side surface of the flow path forming substrate 10 from the communicating plates 15 to 15B, on the opposite surface side of the spacers 25 to 25C from the communicating plate 15 or the like. In other words, it is sufficient that the attachment position of the portion of the nozzle plate 20 and the attachment position of the portion of the protective member be different positions in the third direction Z. Incidentally, the protective member protects the flow path member. Accordingly, in each of the embodiments described above, a protective member configured by or includes the compliance substrate 45 and the cover head 130 is exemplified. However, embodiments of the invention are not particularly limited thereto, and a configuration may be adopted in which only the cover head 130 is attached to the communicating plates 15 to 15B, the spacer 25A or the like as the protective member without providing the compliance substrate 45. In addition to the cover head 130, a wind ripple cover or the like, which suppresses the occurrence of wind ripples in which the landing positions of the ink droplets are shifted by the wind that accompanies the movement of the ink jet recording head II, may be used as the protective member.

Furthermore, one of the cover heads 130 (the exposing opening portion 131) is provided in relation to one of the head main bodies 11. However, embodiments of the invention are not particularly limited thereto. For example, one cover head may also be provided in relation to a plurality (two or more) of the head main bodies 11. In this case, in the cover head, one of the exposing opening portions 131 may be provided for each of the head main bodies 11. Alternatively, a plurality of the head main bodies 11 may be exposed by one of the exposing opening portions 131.

In addition, in each of the embodiments described above, the piezoelectric actuator 300 may be a thin film type and may be used as the pressure generating unit that generates a pressure change in the pressure generating chamber 12. However, embodiments of the invention is not particularly limited thereto. For example, a configuration may be adopted which uses a piezoelectric actuator of a thick film type (which is formed using a method such as bonding green sheets), a piezoelectric actuator of a longitudinal oscillation type in which a piezoelectric material and an electrode forming material are alternately laminated and caused to expand and contract in an axial direction, and the like. In addition, as the pressure generating unit, it is possible to use a unit in which a heating element is disposed within a pressure generating chamber and liquid droplets are discharged from a nozzle opening due to a bubble generated by the heating of the heating element. It is also possible to use a so-called electrostatic actuator, which generates static electricity between the vibration plate and an electrode and causes liquid droplets to be discharged from a nozzle opening by causing the vibration plate to deform using electrostatic force.

Figure 10:
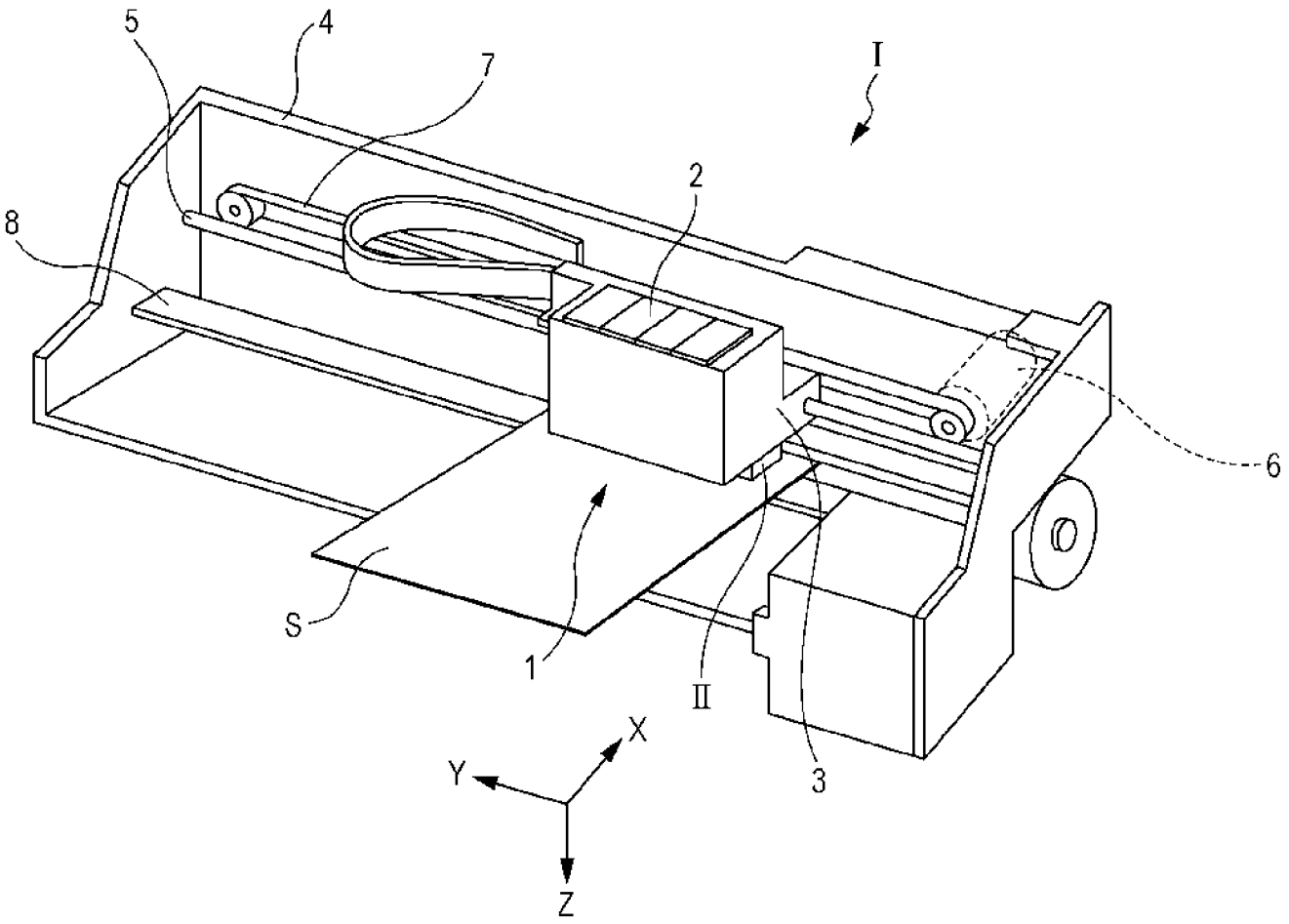
FIG. 10 is a schematic view of an example of a recording apparatus.

In addition, the ink jet-type recording head II of each of the embodiments configures a portion of the ink jet recording head unit. The recording head unit includes ink flow paths that communicate with an ink cartridge or the like, and is mounted on an ink jet-type recording apparatus. FIG. 10 is a schematic view showing an example of the ink jet recording apparatus.

In the ink jet-type recording apparatus I shown in FIG. 10, ink jet recording head units 1 (hereinafter also referred to as the head units 1) that include a plurality of the ink jet recording heads II are provided such that cartridges 2A and 2B that configure an ink supplying unit can be mounted and removed. A carriage 3, on which the head units 1 are mounted, is provided to be freely movable in an axial direction of the carriage shaft 5 that is attached to an apparatus main body 4. The recording head units 1, for example, respectively discharge a black ink composition and a color ink composition.

Furthermore, the carriage 3 to which the head unit 1 is mounted moves along the carriage shaft 5 due to the drive force of the drive motor 6 being transmitted to the carriage 3 via a plurality of gears (not shown) and a dynamic belt 7. Meanwhile, in the apparatus main body 4, a platen 8 is provided along the carriage shaft 5, and a recording sheet S, which is a recording medium such as paper fed by a paper feed roller or the like (not shown), is wound around the platen 8 and transported.

Furthermore, in the ink jet recording apparatus I described above, a configuration was exemplified in which the ink jet recording heads II (the head units 1) are mounted on the carriage 3 and move in the main scanning direction. However, embodiments of the invention are not particularly limited thereto. For example, embodiments of the invention may also be applied to a so-called line recording apparatus, in which the ink jet recording head II is fixed and printing is performed by causing only the recording sheet S such as the paper to move in the sub-scanning direction.

In addition, in the example described above, the ink jet recording apparatus I is configured such that the ink cartridge 2, which is the liquid storage unit, is mounted on the carriage 3. However, the invention is not limited thereto, For example, the liquid storage unit such as an ink tank may be fixed to the apparatus main body 4, and the storage unit and the ink jet recording head II may be connected to one another via a supply tube such as a tube. In addition, the liquid storage unit may also not be mounted on the ink jet recording apparatus.

Furthermore, embodiments of the invention widely targets liquid ejecting heads in general. For example, embodiments of the invention can be applied to recording heads such as a variety of ink jet recording heads that are used in an image recording apparatus such as a printer, a color material ejecting head, which is used in the manufacture of color filters of liquid crystal displays and the like, an electrode material ejecting head, which is used in the electrode formation of organic EL displays, Field Emission Displays (FED) and the like, and a biogenic and organic matter ejecting head, which is used in the manufacture of biochips.

What is claimed is:

1. A liquid ejecting head, comprising:

a nozzle plate including a nozzle opening provided on a first surface of a flow path member with a flow path formed therein; and a protective member including a flexible portion that seals a portion of the flow path provided on the first surface of the flow path member, wherein the nozzle plate does not overlap the protective member in a plan view, wherein a position of a portion of the flow path member onto which the nozzle plate is attached and a position of a portion of the flow path member onto which the protective member is attached are different from one another in a discharge direction of a liquid.

2. The liquid ejecting head according to claim 1, wherein the flow path member includes:

a flow path forming substrate, wherein a pressure generating chamber is formed in the flow path forming substrate, and a communicating plate that is provided on a nozzle plate side of the flow path forming substrate.

3. The liquid ejecting head according to claim 2, wherein the position of the portion of the flow path member onto which the nozzle plate is attached and the position of the portion of the flow path member onto which the protective member is attached are adjusted to be different from one another according to an adjustment of a thickness in a lamination direction between the communicating plate and the flow path forming substrate.

4. The liquid ejecting head according to claim 2, wherein the flow path member includes the flow path forming substrate, the communicating plate, and a spacer that is provided on an opposite side of the communicating plate from the flow path forming substrate, and wherein the position of the portion of the flow path member onto which the nozzle plate is attached and the position of the portion of the flow path member onto which the protective member is attached are adjusted to be different from one another according to an adjustment of a thickness in a lamination direction between the spacer and the communicating plate.

5. The liquid ejecting head according to claim 1, wherein the protective member includes a compliance substrate that is provided on the flow path member side and that includes a flexible portion, and a protection plate that is provided on an opposite side of the compliance substrate from the flow path member and that covers the flexible portion.

6. A liquid ejecting apparatus, comprising:

id ejecting head according to claim 1.

7. A liquid ejecting apparatus, comprising:

id ejecting head according to claim 2.

8. A liquid ejecting apparatus, comprising:

id ejecting head according to claim 3.

9. A liquid ejecting apparatus, comprising:

id ejecting head according to claim 4.

10. A liquid ejecting apparatus, comprising:

id ejecting head according to claim 5.

* * * * *